US005163186A

United States Patent [19]

Dolder

[11] Patent Number: 5,163,186

[45] Date of Patent: Nov. 17, 1992

[54] INSTALLATION BLOCK FOR A WATER CLOSET

[75] Inventor: René Dolder, Jona, Switzerland

[73] Assignee: Geberit AG, Switzerland

[21] Appl. No.: 584,047

[22] Filed: Sep. 18, 1990

[30] Foreign Application Priority Data

Sep. 18, 1989 [CH] Switzerland ..... 3385/89

[51] Int. Cl.[5] ..... E03D 1/012; A47K 4/00

[52] U.S. Cl. ..... 4/353; 4/416; 4/420.4; 264/46.4; 264/271.1

[58] Field of Search ..... 4/353, 416, 420.1, 420.4, 4/443, 447, 448, 420.5; 156/77, 79; 264/46.4, 46.5, 46.7, 259, 271.1, 275, 277

[56] References Cited

U.S. PATENT DOCUMENTS

| | | | |
|---|---|---|---|
| 261,583 | 7/1882 | Coggin et al. | 4/362 |
| 1,886,920 | 11/1932 | Thomas | 4/420.1 |
| 2,909,787 | 10/1959 | Teahen | 4/353 |
| 3,090,965 | 5/1963 | Panza | 4/353 |
| 3,150,796 | 9/1964 | Hocking et al. | 264/46.5 X |
| 3,760,428 | 9/1973 | Korol | 4/353 |
| 4,283,802 | 8/1981 | Icaran | 4/353 |
| 4,304,016 | 12/1981 | Oguma et al. | 4/420.4 X |
| 4,596,058 | 6/1986 | Nourbakhsh | 4/420.4 X |
| 4,628,548 | 12/1986 | Kurosawa et al. | 4/420.4 X |
| 4,861,968 | 8/1989 | West | 264/46.5 X |

FOREIGN PATENT DOCUMENTS

| | | | |
|---|---|---|---|
| 5497 | of 1907 | United Kingdom | 4/420.5 |
| 993695 | 3/1963 | United Kingdom | 4/416 |

*Primary Examiner*—William A. Cuchlinski, Jr.
*Assistant Examiner*—G. Bradley Bennett
*Attorney, Agent, or Firm*—Pollock, Vande Sande & Priddy

[57] ABSTRACT

The installation block comprises a self-supporting body (1) made of foamed concrete into which a flush tank (2) with an inspection opening (2*a*) is foamed. A spiral hose (3), which forms a normally empty conduit (9) which empties into the flush tank (2) at one end and leads at the other end outwardly to the front side of the installation block (1), is also foamed into the body (1). To attach a water closet with subdouche, a flexible connecting hose (4), which comprises an attachment piece at the bottom end and at the other end is connected directly to the inlet valve of the flush tank, is inserted into the empty conduit (9).

4 Claims, 1 Drawing Sheet

INSTALLATION BLOCK FOR A WATER CLOSET

FIELD OF THE INVENTION

The invention relates to an installation block for a water closet.

BACKGROUND OF THE INVENTION

In a conventional installation block, the flush tank manufactured of plastic is foamed into a self-supporting body made of polyester foam concrete. Supply pipes and connections for water and waste water, wall installation fittings and attachment elements for sanitary devices to be connected are pre-installed accurately and on the operating mechanism side. This installation block is mounted on or in a wall with a brick lining or embedment, or in a light construction wall. In order to be able to attach, if desired, also a water closet with subdouche to this installation block, a fixed copper pipe line, which empties at the top into the flush tank and is connected there to the inlet valve with a separate connecting piece, is foamed into the foam body. The other end of the copper pipe, which empties outwardly, comprises a flange for attaching the connecting pipe to the subdouche of the water closet. Installation of this copper pipe line is time-consuming, since the copper pipe must be bent accurately and foamed precisely into position. The manufacturing costs of the installation block are significantly increased by this copper piping. Access to the interior of the flush tank through the inspection opening is poor, for which reason attachment of the upper end of the copper pipe line to the inlet valve is very time-consuming.

SUMMARY OF THE INVENTION

The object of the invention is to provide an installation block of the type described that avoids these drawbacks and, thus, can be manufactured more easily and cost effectively, and is easier to assemble.

A flexible connecting hose is inserted into a normally empty conduit of the installation block only when a connecting pipe for the subdouche is necessary. This flexible connecting hose can be connected directly to the inlet valve, thus significantly simplifying the assembly.

According to another embodiment of the invention, the empty conduit is formed by a foamed-in spiral hose. This permits simple and cost-effective manufacture of the conduit.

According to another embodiment of the invention, the connecting hose projects with one end into the flush tank and is connected there directly to the inlet valve. The other end, projecting outwardly, comprises a flange to attache a connecting pipe to the subdouche. Thus, a connecting flange for attachment to the subdouche is necessary only when a subdouche is also installed.

If the installation block comprises two empty conduits according to another embodiment of the invention, a subdouche can be attached selectively either on the left or the right next to the toilet bowl to the same installation block. Other advantageous features will appear from the following description.

BRIEF DESCRIPTION OF THE DRAWINGS

An embodiment of the invention is explained in detail with reference to the accompanying drawings.

DESCRIPTION OF PREFERRED EMBODIMENT

Figure 1:
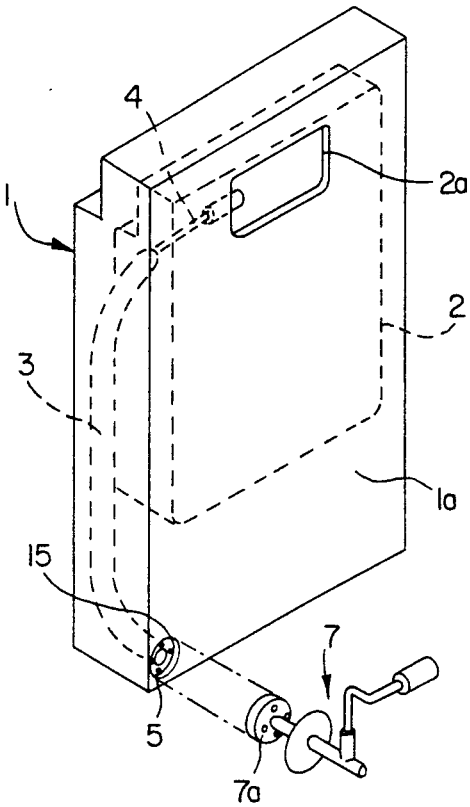
FIG. 1 is a schematic, perspective view of an installation block according to the invention.
Figure 2:
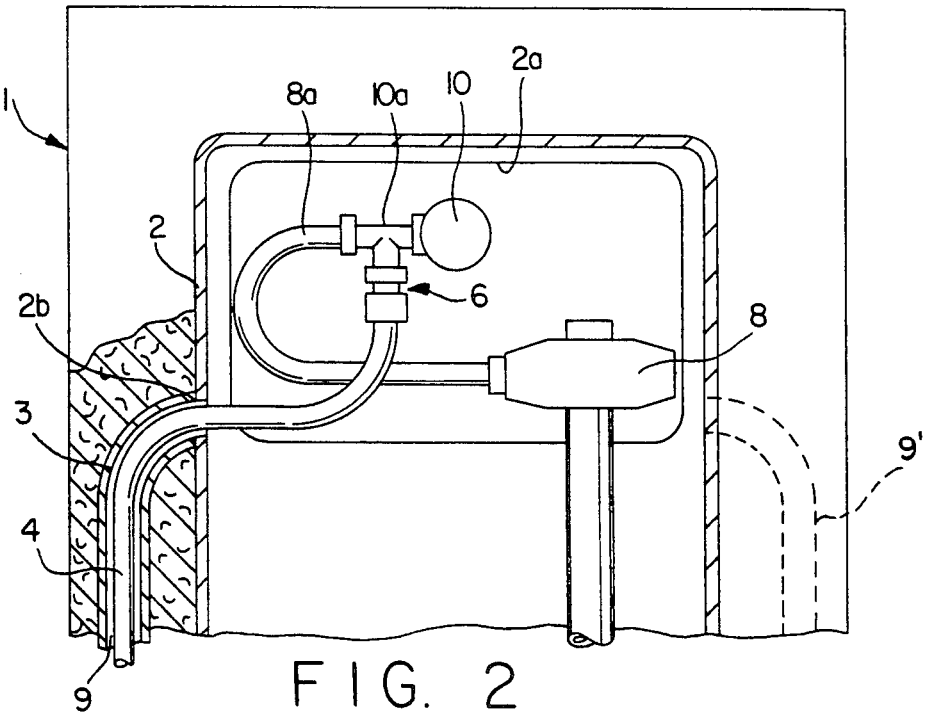
FIG. 2 is a partial cross sectional view of the upper part of an installation block.

The installation block shown in FIGS. 1 and 2 comprises a self-supporting body 1, for example, made of polyester foamed concrete into which a conventional flush tank 2 is foamed. The interior of flush tank 2 is accessible by means of an inspection opening 2*a*. The flush tank comprises a conventional charging valve 8 and conventional fittings (not shown here) and attachments, which are usually also foamed into body 1. The installation block also comprises means (not shown) to attach it into or on a wall.

On the side next to flush tank 2, a spiral hose 3, which leads, as shown in FIG. 2, at the top to an opening 2*b* of flush tank 2, is foamed into body 1. The other bottom end of spiral hose 3 leads at the front side 1*a* of the installation block to the outside. On this bottom end, body 1 has an opening 15, whose purpose is explained in detail below. This foamed-in spiral hose forms a normally empty conduit 9 that is open at both ends. As shown in FIG. 2, the body 1 may comprise a second normally empty conduit 9', debouching outwardly towards the bottom on the right.

Figure 3:
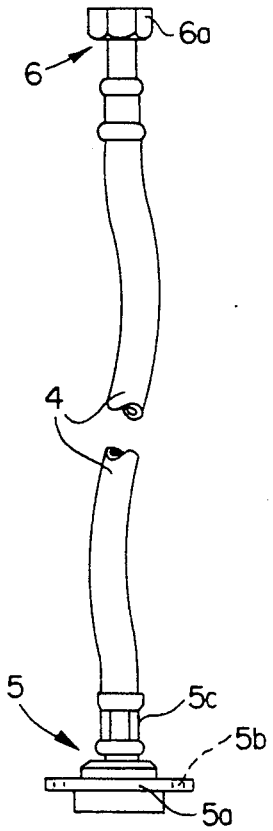
FIG. 3 is a view of a flexible connecting hose.

If this installation block is used for a water closet without the subdouche, conduit (9 and 9') remains unused. If, on the other hand, the water closet has a subdouche, the flexible connecting hose shown in FIG. 3 is inserted from below into the empty conduit. The connecting hose comprises a hose 4 with a steel mesh on whose one end an attachment piece 5 is firmly attached by means of a clamp 5*c*. Attachment piece 5 with flange 5*a* is inserted into opening 15 and fastened by means of screws 5*b* that simultaneously attach a flange 7*a* of connecting piece 7 to body 1.

Connecting piece 7 forms the connection between connecting hose 4 and the subdouche (not shown). An attachment piece 6 is attached to the upper end of hose 4 by a nut 6*a* with which the connecting hose is attached by means of a T-piece 10*a* to valve 10 of flush tank 2. Changing valve 8 is also attached by means of a hose 8*a* to inlet valve 10. Thus, the flush tank and the subdouche can be supplied with water by means of inlet valve 10.

What is claimed is:

1. Installation block comprising a self-supporting body (1) into which (a) a flush tank (2) and (b) supply lines and connections for the flush tank and a water closet are foamed, wherein the body (1) has at least one foamed-in elongate hose which forms a normally empty conduit (9), open at both ends thereof, a first upper end of said conduit leading into said flush tank (2) and a second lower end below said flush tank (2) leading outwardly, a flexible connecting hose (4) being insertable into said conduit (9) and being connectable to an inlet valve (10) provided within said flush tank.

2. Installation block according to claim 1, wherein said conduit (9) is formed by a foamed-in spiral hose (3).

3. Installation block according to claim 1, comprising a connecting hose inserted into said conduit, wherein said connecting hose (4) has a first end projecting into said flush tank (2) and is connected there directly to said inlet valve (10) of said flush tank, a second end of said connecting hose (4) projecting outwardly and comprising a flange for attaching a connecting pipe to a sub-douche.

4. Installation block according to claim 1, wherein said body (1) comprises two normally empty conduits (9, 9'), a first of said conduits debouching at the bottom left of a front side (1*a*) of said installation block (as seen in FIG. 1), and a second of said conduits debouching outwardly on the bottom right of said front side (1*a*) of said installation block.

* * * * *